US005247714A

United States Patent [19]

Lipps

[11] Patent Number: 5,247,714

[45] Date of Patent: Sep. 28, 1993

[54] CONVERTIBLE MATTRESS SYSTEM

[76] Inventor: John D. Lipps, 2075 Case Parkway South, Twinsburg, Ohio 44087

[21] Appl. No.: 947,605

[22] Filed: Sep. 30, 1992

[51] Int. Cl.[5] ..... A47C 27/00; A47C 27/14

[52] U.S. Cl. ..... 5/462; 5/900.5; 5/465

[58] Field of Search ..... 5/465, 462, 464, 632, 5/900.5, 448

[56] References Cited

U.S. PATENT DOCUMENTS

| | | | |
|---|---|---|---|
| Re. 21,580 | 9/1940 | Hutchinson | 5/462 |
| 1,548,728 | 8/1925 | Milam | 5/462 |
| 2,462,579 | 2/1949 | Warner | 5/462 |

*Primary Examiner*—Alexander Grosz
*Attorney, Agent, or Firm*—John L. Gray

[57] ABSTRACT

Applicant's invention comprises a mattress system which may be used as a conventional mattress or with minor modification may have a recess formed at one end thereof whereby an individual's arm may be comfortably placed in such recess with the individual's head resting on a pillow in the recess. By thus positioning an individual on applicant's invention stress in the lumbar and cervical spine areas of the body is reduced. The mattress system includes two oppositely disposed flat recesses at one end of the mattress, with each of the recesses containing, releasably fastened thereto, at least two detachable pads positioned in side-by-side relationship.

1 Claim, 2 Drawing Sheets

CONVERTIBLE MATTRESS SYSTEM

BACKGROUND OF THE INVENTION

Using conventional mattresses, individuals who suffer from carpal tunnel syndrome and others who sleep on their side often have problems in blood circulation due to the pressure being exerted by the weight of the head and the upper body upon the arms and because of the limited positioning options for an individual's arms. For those individuals who suffer lower back pain and muscle fatigue or who are recovering from surgical procedures, conventional mattresses do not provide comfortable sleeping supports.

There are a number of patents that have addressed this problem with special construction shapes, configurations, both fixed and adjustable, to make lying down more comfortable, particularly to persons recovering from various orthopedic surgery operations. Representative of these is U.S. Pat. No. 4,256,096, Budde, which is a particular type of surgical mattress, the center portion of which conforms to the body shape and which can be placed on a regular mattress for patient recovery of a spinal or neck injury with various sized pads to support the head and shoulders of the patient. Neither this patent nor any of the other references set forth in the accompanying Information Disclosure Statement provide a mattress system which may be used in a conventional manner or when modified in accordance with the invention may provide comfortable sleeping for someone who is required as a result of surgical procedures or by choice to sleep on one's side.

SUMMARY OF THE INVENTION

Applicant's invention comprises a mattress system which may be used as a conventional mattress or with minor modification may have a recess formed at one end thereof whereby an individual's arm may be comfortably placed in such recess with the individual's head resting on a pillow in the recess. By thus positioning an individual on applicant's invention stress in the lumbar and cervical spine areas of the body is reduced.

The invention also permits in the double-, queen-, or king-size versions to have one individual have the advantage of the invention while the other individual can sleep in a conventional fashion.

It is therefore an object of this invention to provide a mattress system which will enable an individual to sleep with one's arm positioned at a lower level than the balance of one's body.

It is a further object of this invention to provide such a mattress system which will permit one individual to sleep with the individual's arm positioned below the level of the individual's body and the companion sleeper to sleep in the normal mattress fashion.

It is a still further object of this invention to provide a mattress system which may be turned periodically and still provide the advantages of this invention.

These, together with other objects and advantages of the invention will become more readily apparent to those skilled in the art when the following general statements and descriptions are read in the light of the appended drawings.

DETAILED DESCRIPTION OF THE INVENTION

Figure 1:
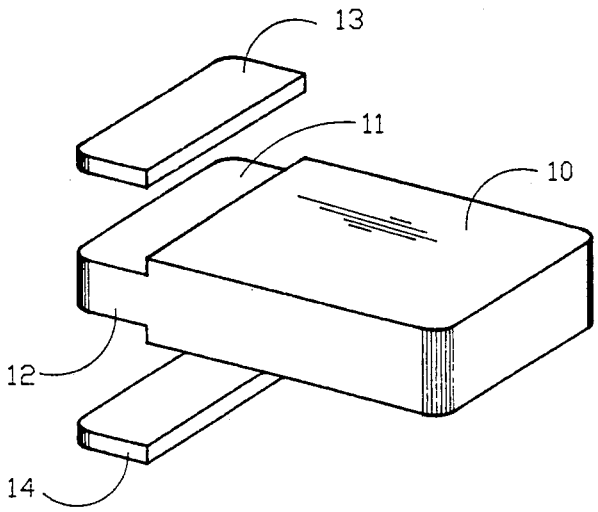
FIG. 1 is an exploded perspective view of one variation of applicant's invention.

Referring now more particularly to FIG. 1, a mattress 10 is shown provided with oppositely disposed recesses 11 and 12 and detachable pads 13 and 14 of a size and shape adapted to fit into recesses 11 and 12. Recesses 11 and 12 and pads 13 and 14 may be provided with hook and loop type strips 17, some of which are shown in FIG. 1, to keep the pads 13 and 14 in place in certain circumstances such as is shown in FIG. 2.

Figure 2:
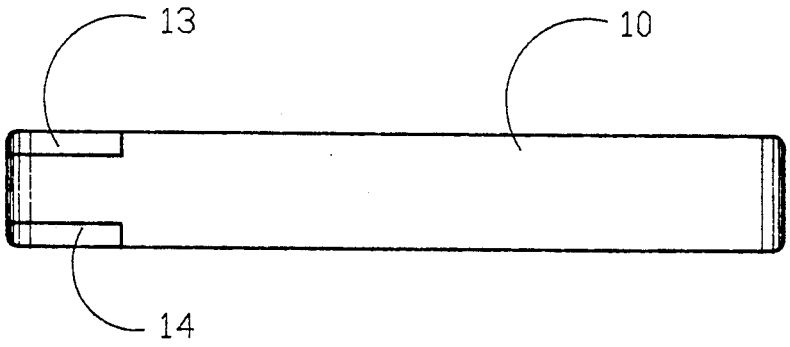
FIG. 2 is a side elevation of FIG. 1 with the detachable pads shown attached to said mattress body.

Referring now more particularly to FIG. 2, the pads 13 and 14 are shown held in place on the mattress 10.

Figure 3:
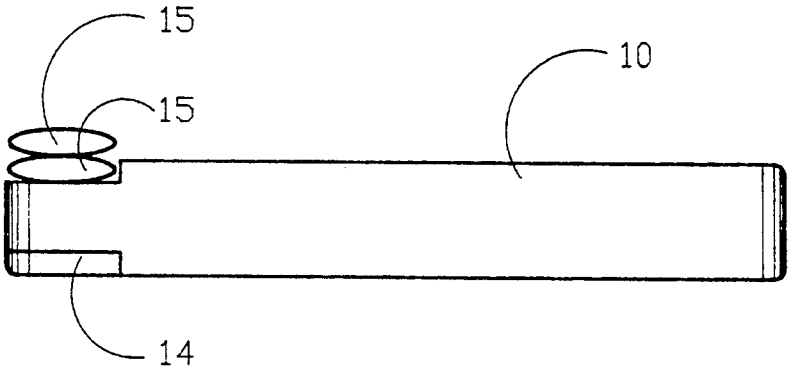
FIG. 3 is a side elevation view of said mattress with one of the pads removed and pillows positioned therein.

FIG. 3 shows the mattress 10 with one of the pads 13 removed and pillows 15—15 positioned in the recess 11 provided by the removal of pad 13.

Figure 4:
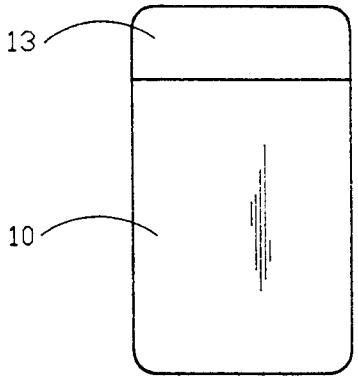
FIG. 4 is a top view of the mattress system shown in FIG. 2.

FIG. 4 shows a top view of the mattress 10 with the pad 13 in place.

Figure 5:
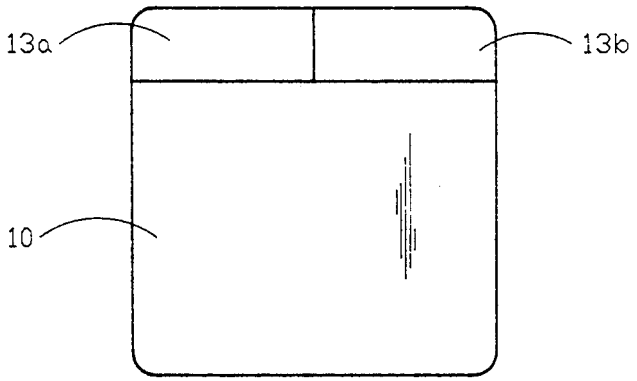
FIG. 5 is a top view of the mattress system for a bed of a mattress of a size to accommodate two individuals.

FIG. 5 shows a top view of the mattress 10 in a double-, queen-, or king-size configuration with two companion pads 13*a* and 13*b* in place.

Figure 6:
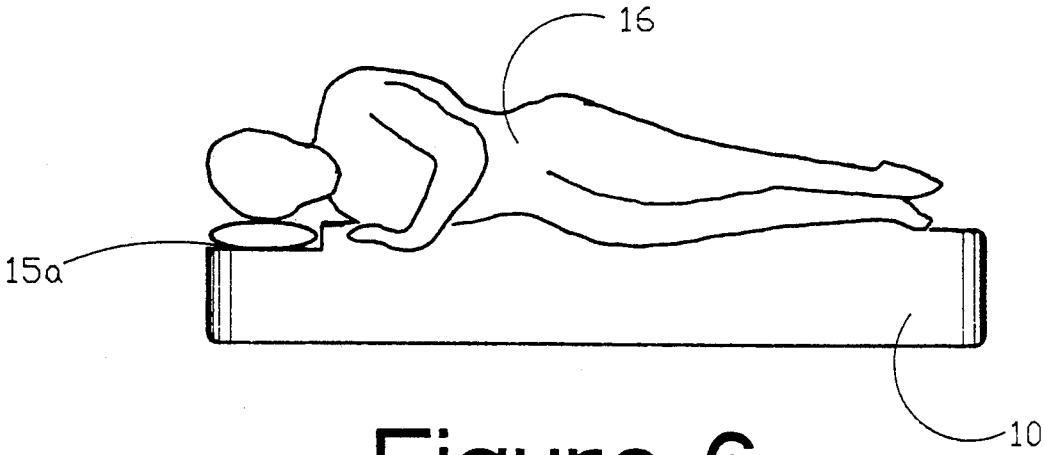
FIG. 6 shows an individual positioned on the mattress of the invention with one of the pads removed, the individual's arm being positioned in the recess with the individual's head on a pillow.

FIG. 6 is similar to FIG. 3 in that the mattress 10 is shown with a pad 13 removed and a pillow 15*a* placed therein with an individual 16 positioned on the individual's side with the arm of the individual positioned in the recess provided by the removal of detachable pad 13 and with the individual's head resting on pillow 15*a*. The size of the recess that has been found to be very useful is 2–3 inches in depth and about 16 inches in length extending across the entire width of the mattress.

The mattress 10 may be constructed incorporating the materials and dimensions used in mattress construction today. This would include conventional inner springs, high-density foam and natural and synthetic ticking. The mattress 10 may also comprise construction utilizing water and foam configurations. Preferably the pads 13 and 14 are constructed of high-density foam covered in a material similar to that of the mattress ticking. By utilizing the mattress system of the invention, maximum comfort and flexibility for the sleeper is achieved.

While this invention has been described in its preferred embodiment, it is to be appreciated that variations therefrom may be made without departing from the true scope and spirit of the invention.

What is claimed is:

1. A mattress system comprising a mattress with two oppositely disposed flat recesses at one end thereof extending across the entire width of said mattress, each of said recesses being of a size, shape and thickness to receive at least one pillow and the arm of an individual, while said individual is positioned on said individuals' side on the remainder of said mattress with the said individual's head positioned over said recess;

each of said recesses having been created by removing a detachable pad in said recess of approximately the same size and shape of said recess;

separable fastener means provided on the recesses and pads permitting the removal and reattachment of the pads to the recesses;

each of said recesses containing at least two detachable pads having the total size and shape of said recess and positioned in side-by-side relationship.

* * * * *